US006725747B2

(12) United States Patent
Erwin

(10) Patent No.: US 6,725,747 B2
(45) Date of Patent: Apr. 27, 2004

(54) DIN CONNECTOR WRENCH

(75) Inventor: Christopher Scott Erwin, Wesley Chapel, FL (US)

(73) Assignee: Cingular Wireless, LLC, Atlanta, GA (US)

( * ) Notice: Subject to any disclaimer, the term of this patent is extended or adjusted under 35 U.S.C. 154(b) by 0 days.

(21) Appl. No.: 10/226,942

(22) Filed: Aug. 23, 2002

(65) Prior Publication Data

US 2004/0035259 A1 Feb. 26, 2004

(51) Int. Cl.[7] ..... B25B 13/06
(52) U.S. Cl. ..... 81/124.2; 81/124.7
(58) Field of Search ..... 81/121.1, 124.2, 81/124.3, 119, 124.6, 124.7, 177.5

(56) References Cited

U.S. PATENT DOCUMENTS 798,325 A * 8/1905 Daddysman, Jr. ..... 81/124.2
2,978,353 A * 4/1961 Meier ..... 81/900
4,393,583 A * 7/1983 Zwald ..... 81/124.2
H1689 H * 11/1997 Foucher ..... 81/124.3
6,202,515 B1 * 3/2001 Denton ..... 81/119
6,354,175 B1 * 3/2002 Dobson et al. ..... 81/119
6,378,401 B1 * 4/2002 Lordahl et al. ..... 81/124.4

* cited by examiner

*Primary Examiner*—D. S. Meislin
(74) *Attorney, Agent, or Firm*—Cynthia Parks, Esq.

(57) ABSTRACT

A wrench socket includes a socket connection portion adapted to receive a lug member. The socket connection portion has a first face and a cavity extending from an interior of the socket connection portion to the first face. This cavity is adapted to engage a lug member. The wrench socket further includes a wrench portion having inner faces which are adapted to engage the periphery of a connector. The inner faces are angularly oriented to each other and disposed along planes substantially perpendicular to the first or second face of the socket connection portion. The inner faces bound an open gripping region such that the inner faces are slidably engagable with the connector along a plane perpendicular to the inner faces. The wrench socket further includes a mid portion connecting the socket connection portion to the wrench portion. The mid portion is disposed axially between the socket connection portion and the wrench portion at a point near the periphery of the socket connection portion and the wrench portion such that an area adapted to receive nonrotatable parts exists above the mid portion and between the wrench portion and the socket connection portion.

28 Claims, 8 Drawing Sheets

DIN CONNECTOR WRENCH

DESCRIPTION OF THE INVENTION

1. Field of the Invention

The present invention relates to wrenches and more particularly to a socket wrench adapted for use on nuts or fittings that are not readily accessible with conventional types of socket or other wrenches.

2. Background of the Invention

Because of the dictates of design, many mechanical connections are difficult, if not impossible, to reach with conventional wrenches. For example, it is sometimes necessary to turn nuts that are integrally connected to a communications cable. These nuts are typically threaded onto coaxial cable type connections on communications equipment. The nut itself is typically located around the periphery of an end of the cable. These cable connections are often referred to as DIN or mini-DIN connections. Generally, many of these cables are connected to a piece of communications equipment so that the cables are located in close proximity to each other. In such a case, the use of a conventional closed-end box wrench is precluded. Moreover, the existence of adjacent cables and interfering parts prevents the use of a conventional open-end box wrench.

In an attempt to provide a wrench that can be used in such restrictive installations, a number of sectional or segmented type wrenches have been developed. For example, it is known to pivotally connect matching axially segmented halves of a box type wrench so that the halves can be pivoted apart, slipped about the nut, and pivoted back in engagement about the nut. In addition, it is known to split conventional sockets into two coacting halves that can be placed about the nut. Also, it is known to orient the handle of an open-end box wrench at a right angle to the end that engages the nut. A similar configuration integrates a socket connection. In a socket wrench manufactured by and available from Powerwave Technologies of Santa Ana, Calif., two faces of the wrench end that engage the nut extend upward to form a significant lip. In this manner, the two faces extend significantly beyond the periphery of the nut.

Certain deficiencies are inherent in these and other conventional devices. The first two devices have relatively wide wrench jaws that do not permit accessibility in constrained spaces or in spaces with adjacent cables or interfering parts. Further, engagement of these wrenches about a fitting is sometimes very difficult in hard to reach spaces. The latter described wrenches possess relatively wide jaws to transmit force without breaking. Further, the arrangement of the handle, perpendicular to the plane of the end that engages the nut is inefficient and mechanically limits the torque that can be delivered to the nut. Moreover, the faces of the wrench end that engage the nut are either too long or too bulky to allow for proper engagement of the nut in constrained areas. None of these conventional tools provides the necessary configuration to efficiently manipulate the nuts associated with communications cables in tight spaces. Moreover, each of these tools is capable of damaging the cable connection or the cable itself.

A common solution specific to communications equipment, depicted in FIG. 1, is the use of pliers with an elastic insert on the gripping end. As is shown in FIG. 1, a pair of pliers includes handles 115, gripping jaws 110, and an elastic insert 105. The handle 115 is gripped thus engaging the gripping jaws 110 and accompanying elastic insert 105 around a nut. The handle 115 is then rotated so as to manipulate the nut. With this tool, it is important to maintain a tight grip on the handle 115 so that force can be transferred to the nut.

This commonly used device, however, has many disadvantages. First, it is difficult to maneuver the gripping jaws 110 around the nut in a confined space. Moreover, the elastic insert, when engaged about the nut, often slips when the handle 115 is rotated, thus preventing torque from being transferred to the nut. This slippage may also damage the cable connection or the cable itself. In addition, the configuration of the handle 115 and gripping jaws 110, in the same plane, leads to an inefficient transfer of force to the nut.

Therefore, a particular need exists for a wrench that overcomes these difficulties in the confined connection spaces that exist on communications equipment. The present invention addresses one or more of the above issues.

SUMMARY OF THE INVENTION

In accordance with the invention, a wrench socket includes a socket connection portion adapted to receive a lug member, the socket connection portion having a first face, the socket connection portion having a cavity extending from an interior of the socket connection portion to the first face, the cavity adapted to engage the lug member; a wrench portion having inner faces which are adapted to engage the periphery of a connector, the inner faces angularly oriented to each other and disposed along planes substantially perpendicular to the first face of the socket connection portion, the inner faces bounding an open gripping region such that the inner faces are slidably engagable with the connector along a plane perpendicular to the inner faces; and a mid portion connecting the socket connection portion to the wrench portion, the mid portion disposed axially between the socket connection portion and the wrench portion at a point near the periphery of the socket connection portion and the wrench portion such that an area adapted to receive nonrotatable parts exists above the mid portion and between the wrench portion and the socket connection portion.

In another aspect of the present invention, a wrench socket includes a socket connection portion adapted to receive a lug member, the socket connection portion having a first face, the socket connection portion having a cavity extending from an interior of the socket connection portion to the first face, the cavity bounded by four interior surfaces disposed at substantially right angles to one another so as to form a substantially cuboid space, the four interior surfaces disposed substantially perpendicular to the first face, the cavity adapted to engage the lug member; a wrench portion having inner faces and curved channels that are adapted to engage the periphery of a DIN-type connector, the inner faces angularly oriented to each other and disposed along planes substantially perpendicular to the first face of the socket connection portion so as to be engagable with a DIN-type connector, the inner faces bounding an open gripping region such that the inner faces are slidably engagable with the connector along a plane parallel to the inner faces; wherein a length of a first inner face is less than a length of a second inner face; wherein the curved channels are axially disposed between the inner faces, axial lines of the curved channels aligned parallel to the inner faces, the curved channels disposed along lines defined by the intersection of two planes of the inner faces; the wrench portion further comprising an outer surface, wherein a distance between the inner faces and the outer surface facilitates insertion of the wrench portion into a confined space; and a mid portion connecting the socket connection portion to the wrench portion, the mid portion disposed axially between the socket connection portion and the wrench portion at a point near the periphery of the socket connection portion and the wrench portion such that an area adapted to receive nonrotatable parts exists above the mid portion and between the wrench portion and the socket connection portion, wherein a center of the cavity of the socket connection portion is aligned substantially axially with a center of a gripping region bounded by the inner faces of the wrench portion.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention.

DESCRIPTION OF THE EMBODIMENTS

Reference will now be made in detail to exemplary embodiments of the invention, examples of which are illustrated in the accompanying drawings. Wherever possible, the same reference numbers will be used throughout the drawings to refer to the same or like parts.

Figure 5:
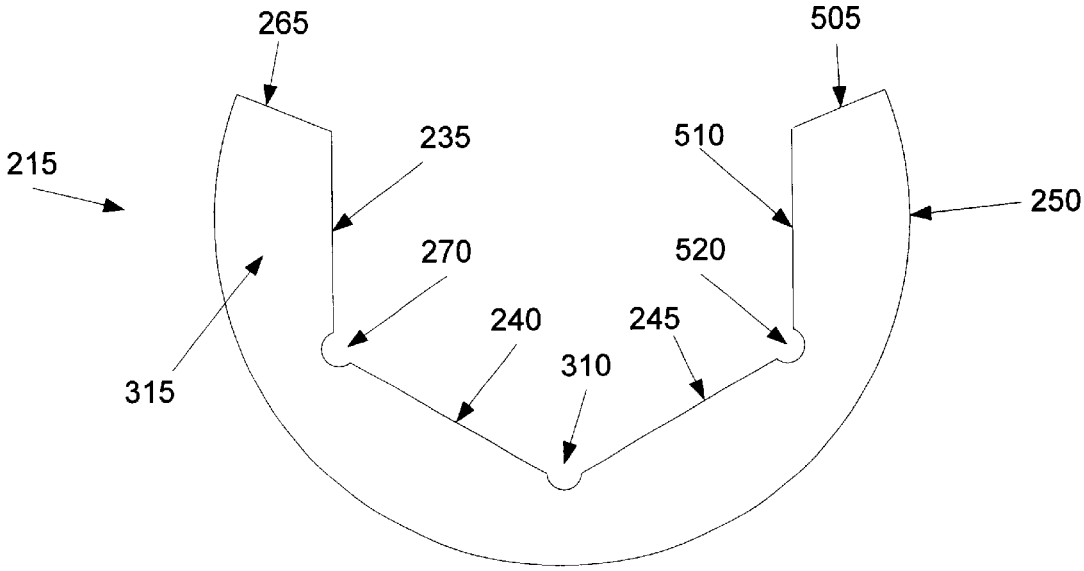
FIG. 5 is a front elevation view of the wrench sockets of FIGS. 2, 3, and 4.
Figure 6:
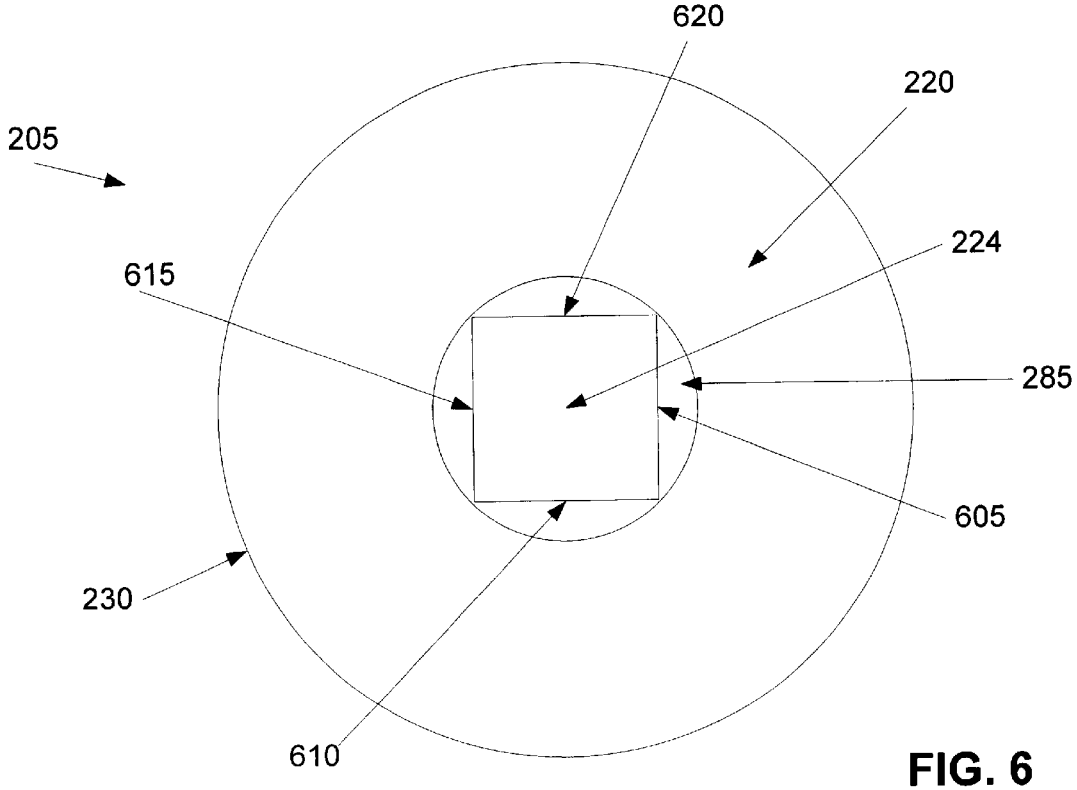
FIG. 6 is a rear elevation view of the wrench sockets of FIGS. 2, 3, and 4.

Consistent with the general principles of the present invention, a wrench socket includes a socket connection portion, a wrench portion, and a mid portion. As herein embodied and illustrated in FIGS. 2, 3, and 4, a wrench socket 200 includes a socket connection portion 205 joined via a mid portion 210 to a wrench portion 215. FIG. 5 is a front elevation view of the wrench portion of the wrench sockets of FIGS. 2, 3, and 4. This view more clearly illustrates the configuration of the inner faces and the curved channels on the end of wrench portion 215 adapted to engage a DIN-type connector. FIG. 6 is a rear elevation view of the socket connection portion of the wrench sockets of FIGS. 2, 3, and 4. This view more clearly illustrates the configuration of the socket cavity 225 adapted to engage a lug member.

In the exemplary embodiments of FIGS. 2, 3, 4, and 6, the socket connection portion 205 has a substantially circular cross section. In this manner, the outer surface 230 of the socket connection portion 205 approximates the outer surface of a right circular cylinder. A first face 220 is planar and forms one end of the wrench socket 200 of the present invention. First face 220 is also circular in shape and parallel to second face 305 (shown in FIG. 3). A socket cavity 225 extends from an interior of socket connection portion 205 to first face 220. Socket cavity 225 is adapted to receive a lug member such as the lug member on a ratchet (not shown). Bevel 285 facilitates insertion of the lug member into socket cavity 225.

While socket connection portion 205 is depicted as having a circular cross section, socket connection portion 205 may have any cross section and be of any shape. For example, socket connection portion 205 may have a square, rectangular, or elliptical cross section. Likewise, socket cavity 225 may define any shape. In the embodiment of FIG. 6, socket cavity 225 is bounded by four interior surfaces 605, 610, 615, and 620 to form a square cross section. In this manner, socket cavity 225 is substantially cuboid in shape. In other embodiments consistent with the principles of the present invention, socket cavity 225 may have a hexagonal or octagonal cross section. The shape of socket cavity 225 is governed by the shape of the lug member that it receives. Socket cavity 225 is configured to provide a sufficient connection for the lug member.

Figure 1:
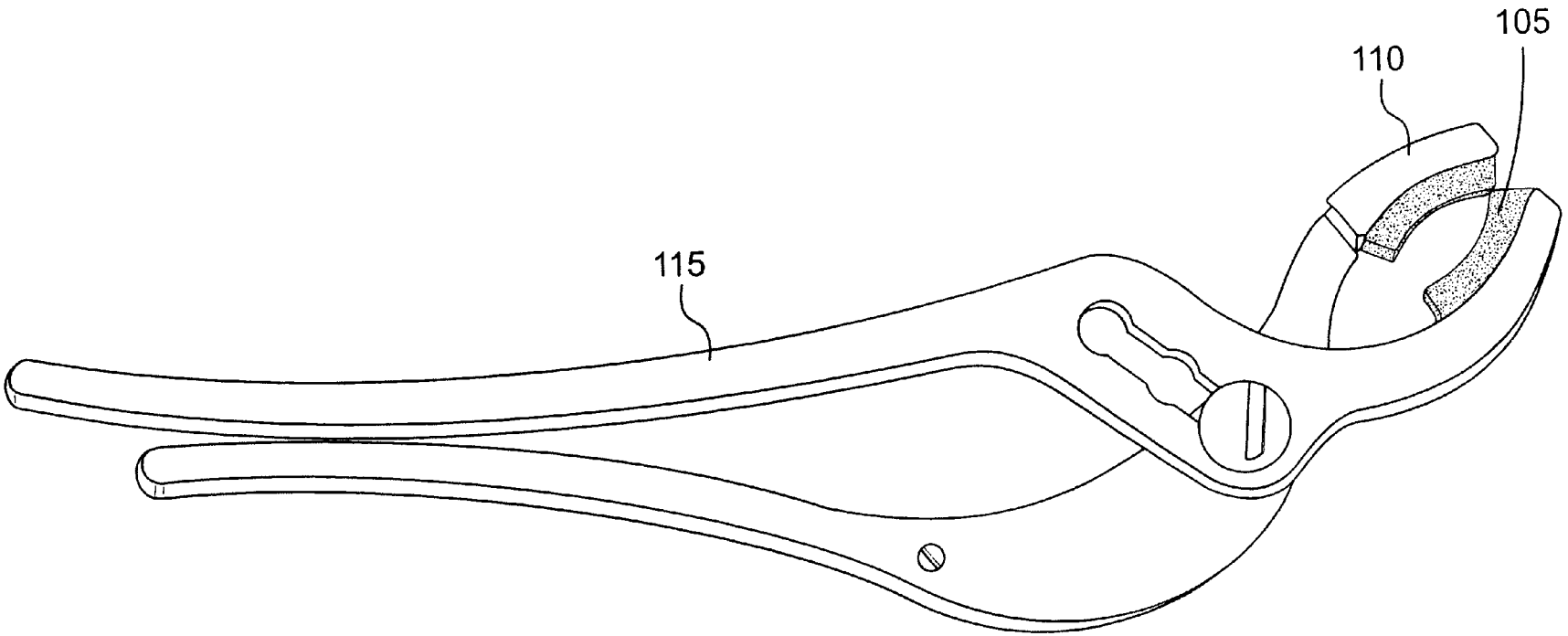
FIG. 1 is perspective view of conventional pliers with an elastic insert on the gripping end.
Figure 2:
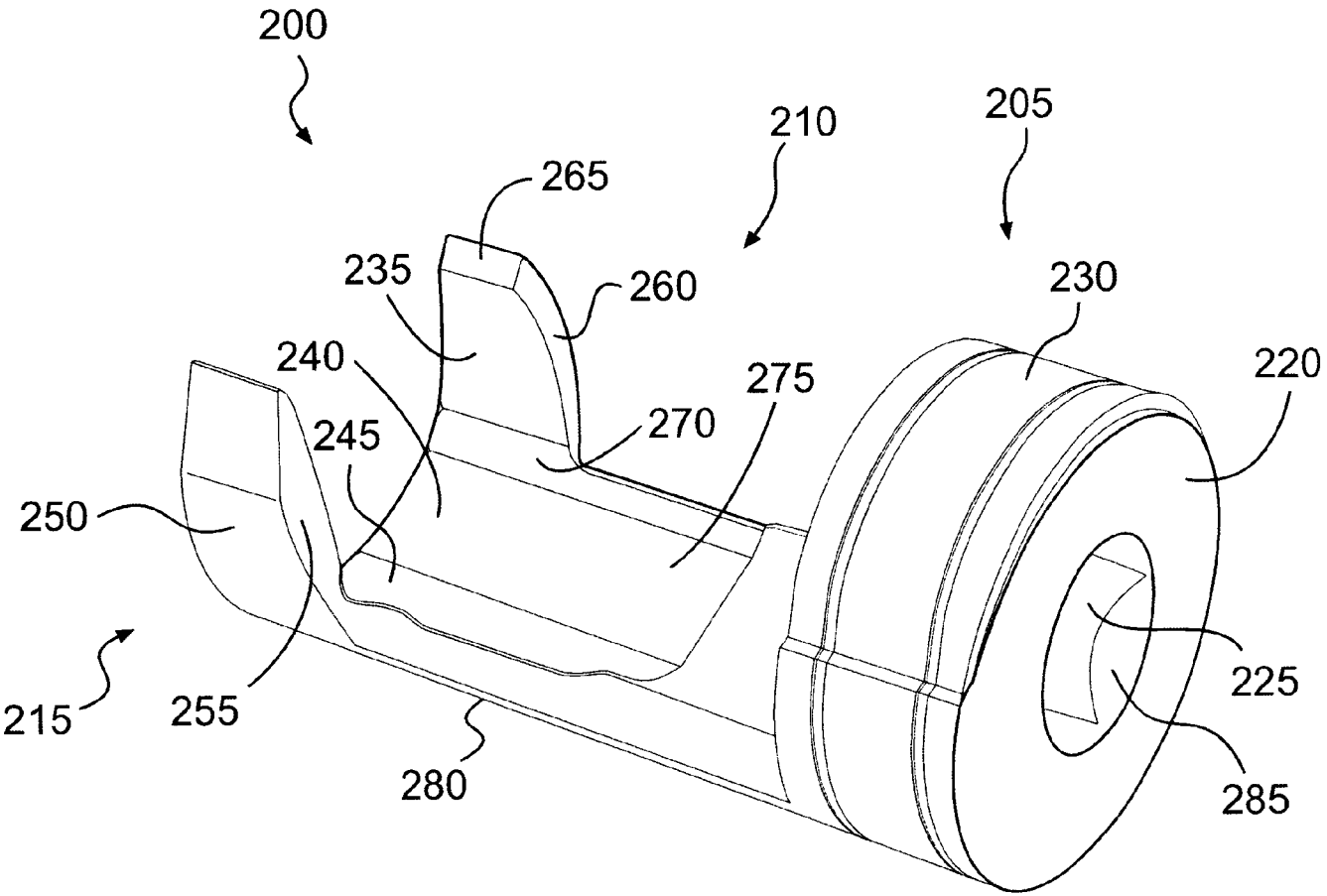
FIG. 2 is a perspective view of the wrench socket consistent with the principles of the present invention.
Figure 3:
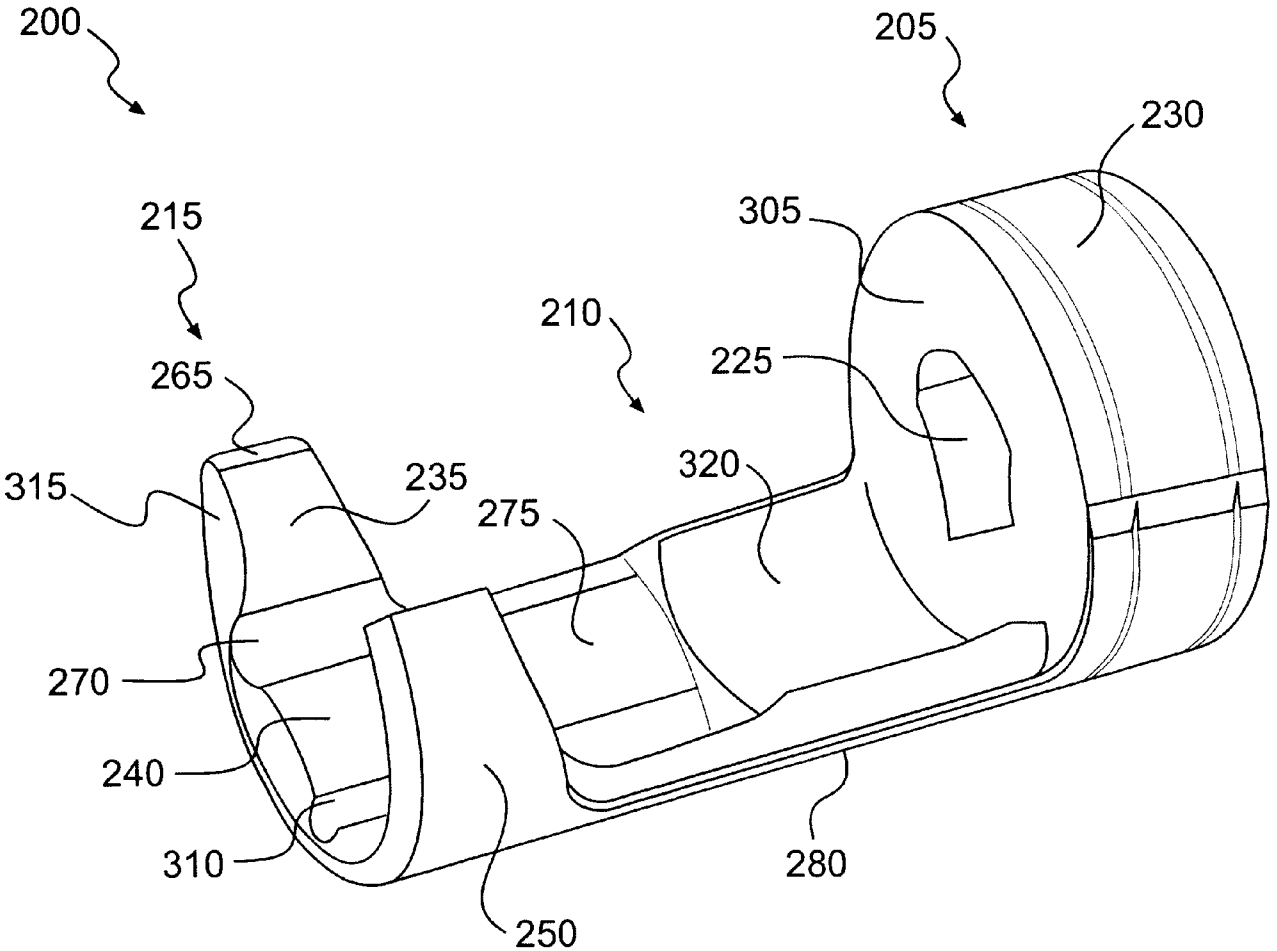
FIG. 3 is a perspective view of the wrench socket of FIG. 2 viewed from a different angle.

In the exemplary embodiment of FIG. 3, the second face 305 of socket connection portion 205 is illustrated. Second face 305 is parallel to first face 220 of FIG. 2. Further, first and second faces 220 and 305 have a similar size and shape and occupy approximately the same surface area. The surface area of second face 305, however, is less than that of first face 220 because of the union of mid portion 210 to socket connection portion 205. This union is clearly illustrated in FIG. 3 as mid portion 210 abuts socket connection portion 205. In this embodiment, mid portion 210 is integrally joined to socket connection portion 205.

Socket cavity 225, in the exemplary embodiment of FIG. 3, is depicted as extending through socket connection portion 205. In this manner, socket cavity 225 extends from first face 220 to second face 305. In this embodiment, socket cavity 225 forms a continuous, straight bore through socket connection portion 205. In other embodiments of the present invention, socket cavity 225 extends from first face 220 to an interior of socket connection portion 205 a sufficient depth to act as a proper receptacle for a lug member.

Referring to FIGS. 2–5, the wrench portion 215 occupies the opposite end of wrench socket 200. In this manner, socket connection portion 205 and wrench portion 215 are arranged at opposite ends of wrench socket 200. Wrench portion 215 has inner faces 235, 240, 245, and 510 adapted to engage the periphery of a connector. These inner faces 235, 240, 245, and 510 are substantially planar and arranged at right angles to the first face of socket connection portion 205. Moreover, these inner faces 235, 240, 245, and 510 are angularly oriented with respect to each other. In the exemplary embodiment of FIGS. 2–5, first inner face 235 is oriented at 120 degrees to second inner face 240. Likewise, second inner face 240 is oriented at 120 degrees to third inner face 245. Fourth inner face 510 is oriented at 120 degrees to third inner face 245. In this embodiment, the inner faces of wrench portion 215 are adapted to engage a hexagonal connector, for example, a DIN-type connector.

While the wrench socket of FIGS. 2–5 is adapted to engage a hexagonal connector, it will be appreciated that wrench portion 215 may contain any number of inner faces so as to engage the periphery of any number of various connectors. For example, wrench portion 215 may contain three inner faces disposed at right angles to one another so as to be adapted for engagement with a square connector or square nut.

In addition, in the exemplary embodiments of FIGS. 2–5, curved or semicircular channels, 270, 310, and 520, may be located at the intersection of the inner faces. For example, curved channel 270 is axially aligned along the intersection of first inner face 235 and second inner face 240. Likewise, curved or semicircular channel 310 is located at the intersection of second and third inner faces, 240 and 245. Curved or semicircular channel 520 is located at the intersection of third inner face 245 and fourth inner face 510. In this manner, the partial regular hexagonal shape traced by the planes of the inner faces 235, 240, 245, and 510 has a semicircular or curved region at its corners. In other words, the sharp corners of the partial hexagonal shape are smoothed by curves with radii smaller than the length of the inner faces 235, 240, 245, and 510. These curved or semicircular channels 270, 310, and 520 extend back from outer edge surface 315 along with inner faces, 235, 240, 245, and 510.

These curved channels 270, 310, and 520 allow the gripping region of the wrench portion 215 traced by the inner faces 235, 240, 245, and 510 to properly engage a DIN-type connector. The embodiment of FIGS. 2–5, with four inner faces and three curved channels, is adapted to fit a standard DIN connector. In this configuration, the curved channels have a small radius and, for a DIN connector, the inner faces 235, 240, 245, and 510 typically have a length of approximately ¾ inches. For other types of DIN connectors, for example a mini-DIN connector, the length of inner faces 235, 240, 245, and 510, is approximately ½ inches or 3/16 inches.

In one embodiment, the length of first inner face 235 may be less than the length of second inner face 240. Likewise, the length of fourth inner face 510 may be less than that of third inner face 245. Generally, the length of second and third inner faces 240 and 245 are approximately the same so that the gripping region bounded by the inner faces is adapted to engage a regular shaped connector. However, the length of first inner face 235 and fourth inner face 510 may be less than that of second and third inner faces 240, 245 so that the wrench socket better fits in a confined area. The upward extension of first and fourth inner faces 235 and 510 can lead to problems in inserting the wrench socket 200 into a confined space. If first and fourth inner faces 235 and 510 extend too far upward, then the outer surface 250 and bevels 265 and 505 of wrench portion 215 may contact adjacent fittings so as to render wrench socket 200 less suitable for use in tight spaces. Therefore, in one possible embodiment of the present invention, the length of first inner face 235 and fourth inner face 510 may be kept to a minimum length required so that the inner faces properly grip a connector.

The circumferential length of outer surface 250 of wrench portion 215 is related to the length of the inner faces 235, 240, 245, and 510. In the embodiment of FIG. 5, the circumferential outer surface 250 extends around the periphery of wrench portion 215. This outer surface 250 traces an arcuate portion of a circle. In this manner, a cross section of wrench portion 215 is C-shaped. Alternatively, a cross section of wrench portion 215 may be of a shape similar to that bounded by the inner faces 235, 240, 245, and 510. For example, if the inner faces 235, 240, 245, and 510 are angularly oriented to approximate four sides of a hexagon, then outer surface 250 may also approximate four sides of a hexagon. In other embodiments, outer surface 250 may comprise any number of sides.

Bevels 265 and 505 are provided on a top edge of wrench portion 215 to allow for ease of engagement with a connector. Bevel 265 extends angularly upward from first inner face 235 to outer circumferential surface 250. Bevel 505 extends angularly upward from fourth inner face 510 to outer circumferential surface 250. In alternate embodiments, bevels 265 and 505 may be curved or rounded surfaces or flat surfaces at a substantially right angle to first inner face 235 and fourth inner face 510.

Inner edge surfaces 255 and 260 and outer edge surface 315 are related to the thickness of wrench portion 215. Outer edge surface 315 extends circumferentially around the end of wrench portion 215. The intersection of outer surface 250 and outer edge surface 315 approximates a C-shaped portion of a circle. In the embodiments of FIGS. 2–5, the thickness of wrench portion 215 may vary around the circumferential outer surface 215. The thickness is reflected in the size and shape of inner edge surfaces 255 and 260 as well as outer edge surface 315. In one embodiment, the surface area of the inner edge surfaces 255 and 260 and outer edge surface 315 may be kept to a minimum required to provide sufficient strength for wrench portion 215. This embodiment saves on material used to manufacture wrench portion 215 and also facilitates the insertion of wrench portion 215 into confined spaces. In general, the shorter the distance between the inner faces 235, 240, 245, and 510 and the outer circumferential surface 250 (which is reflected in a smaller surface area of the inner edge surfaces 255 and 260 and outer edge surface 315), the easier it is to manipulate wrench portion 215 in tight spaces.

Mid portion 210 connects wrench portion 215 to socket connection portion 205. As shown in the exemplary embodiments of FIGS. 2–4, a lower periphery of wrench portion 215 is connected to a lower periphery of socket connection portion 205 by mid portion 210. In this manner, a continuous curvilinear surface extends across the entire bottom portion of wrench socket 200. This continuous curvilinear surface encompasses a bottom section of the outer circumferential surfaces 230 and 250 of wrench portion 215 and socket connection portion 205, respectively. In the exemplary embodiments of FIGS. 2–4, the three outer circumferential surfaces 230, 250, and 280 of mid portion 210, wrench portion 215, and socket connection portion 205, respectively, form the bottom of wrench socket 200. In addition, in these embodiments, a center of socket cavity 225 is axially aligned with a center of the gripping region traced by the inner surfaces 235, 240, 245, and 510. The longitudinal axes of inner faces (shown as 605, 610, 615, 620 of FIG. 6) of socket cavity 225 are oriented in parallel to the longitudinal axes of inner faces 235, 240, 245, and 510 of wrench portion 215. This arrangement ensures that the inner faces 235, 240, 245, and 510 of wrench portion 215 are substantially perpendicular to first face 220 of socket connection portion 205.

Figure 4:
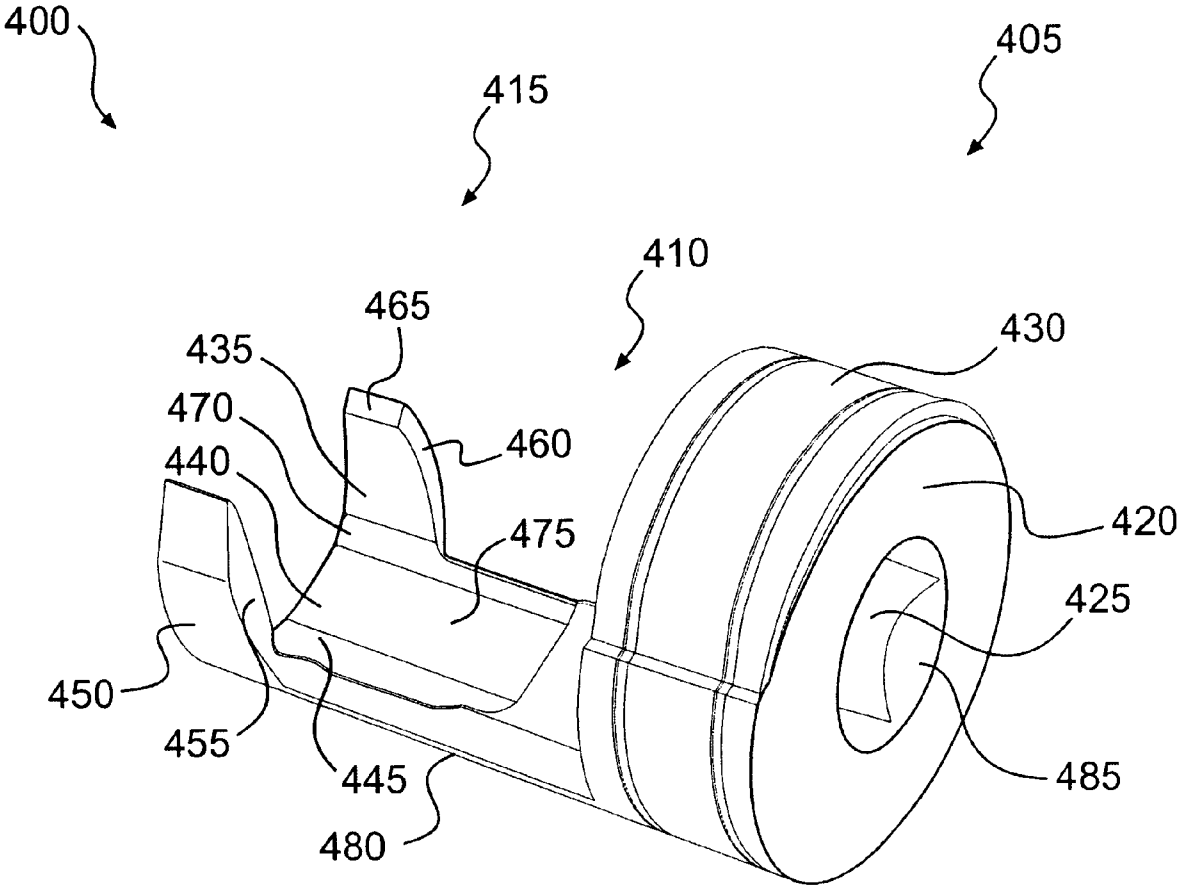
FIG. 4 is a perspective view of a further embodiment of the wrench socket consistent with the principles of the present invention.

A first inner surface 275 of mid portion 210, in the exemplary embodiments of FIGS. 2–4, is a continuation of second inner face 240 of wrench portion 215. Generally, first inner surface 275 of mid portion 210 is oriented so as to better allow wrench portion 215 to engage a connector. In addition, the distance between first inner surface 275 and outer circumferential surface 280 of mid portion 210 typically approximates the distance between second inner face 240 and outer circumferential surface 250 of wrench portion 215. In this manner, the thickness of mid portion 215 is minimized consistent with strength and adaptability requirements of wrench socket 200.

In the exemplary embodiment of FIG. 3, mid portion 210 has a first inner surface 275 and a second inner surface 320. First inner surface 275 is an extension of second inner face 240 of wrench portion 215. Second inner surface 320 is located adjacent to socket connection portion 205 and extends upward from first inner surface 275. In this manner, the interior surface of mid portion 210 has a stepped profile. Generally, the interior surfaces 275 and 320 of mid portion 210 may be of any shape so as to accommodate interface between wrench portion 215 and a connector as well as between socket connection portion 205 and a lug member.

Figure 8:
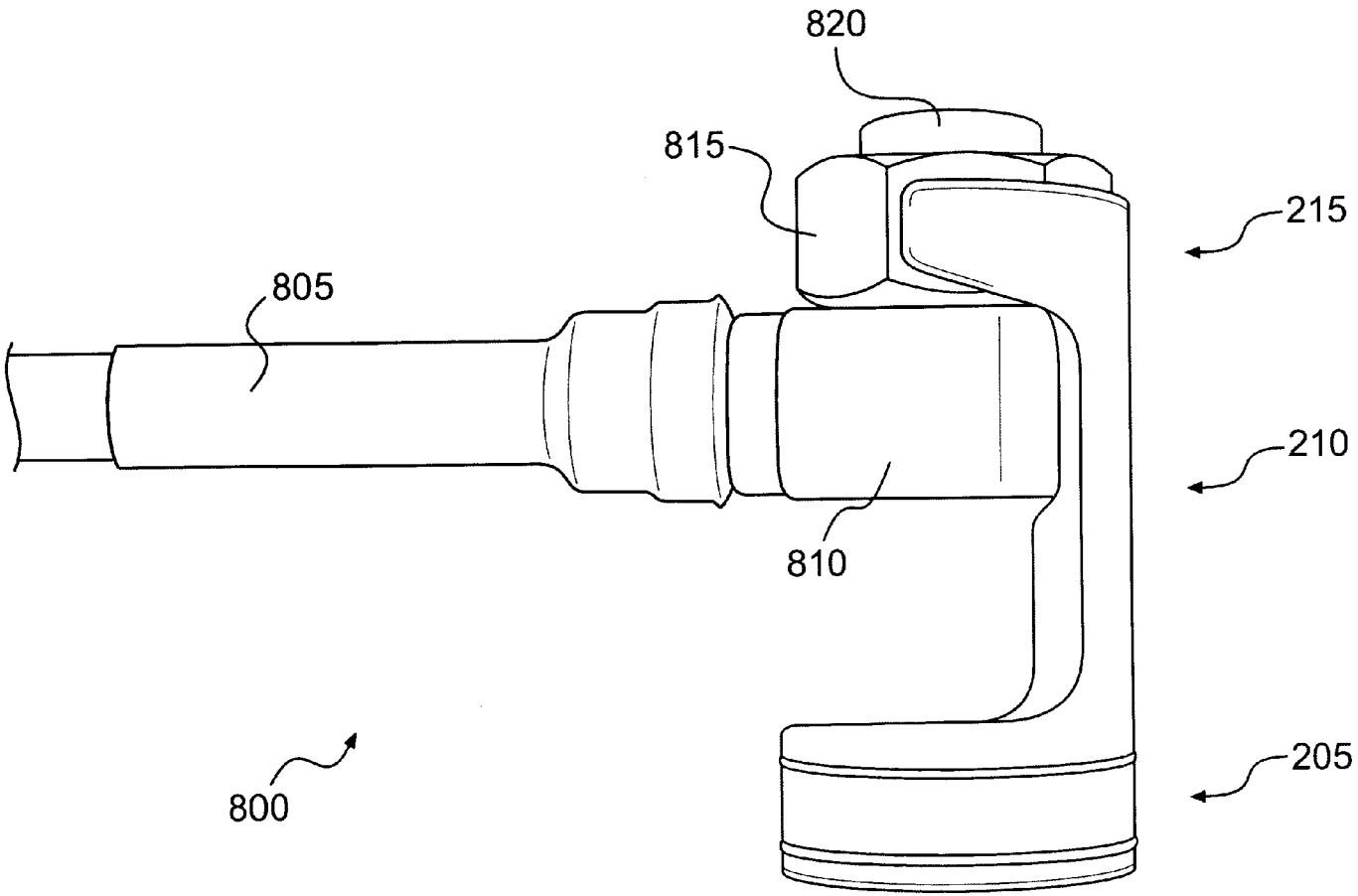
FIG. 8 illustrates the wrench socket consistent with the principles of the present invention positioned on a communications cable of difficult access.

Generally, the length of mid portion 210 is configured to provide enough clearance for the socket connection portion 205. With reference to FIG. 8, the length of mid portion 210 may be such that a sufficient distance exists between housing 810 of communications cable 800 and the second face of socket connection portion 205.

For some special uses, the inner faces 235, 240, and 245 of the wrench portion 215 may be coated with a non-metallic material to further reduce slippage on the fitting, and to protect the fitting from damage. The coating material may be, for example, rubber, plastic, polymer, or elastomer. For example, the coating could be a polyolefin, polyurethane, polyvinyl choride, or TEFLON® fluoropolymer.

FIG. 4 depicts an embodiment of the present invention in which the wrench portion 415 has a smaller diameter than the socket, connection portion 405. This embodiment is suited for use with a mini-DIN connector. In other respects, however, the wrench socket 400 of FIG. 4 has the same qualities and characteristics as the wrench socket 200 of FIGS. 2 and 3. For example, the first face 420, outer circumferential surface 430, socket cavity 425, and bevel 485 of socket connection portion 405 of FIG. 4 are similar to the like components of socket connection portion 205 of FIGS. 2 and 3. As depicted in FIG. 4, wrench portion 415 has a smaller diameter than that of socket connection portion 405. Inner faces 435, 440, and 445 as well as curved channel 470 are oriented in the same manner as those of FIGS. 2 and 3.

Figure 7:
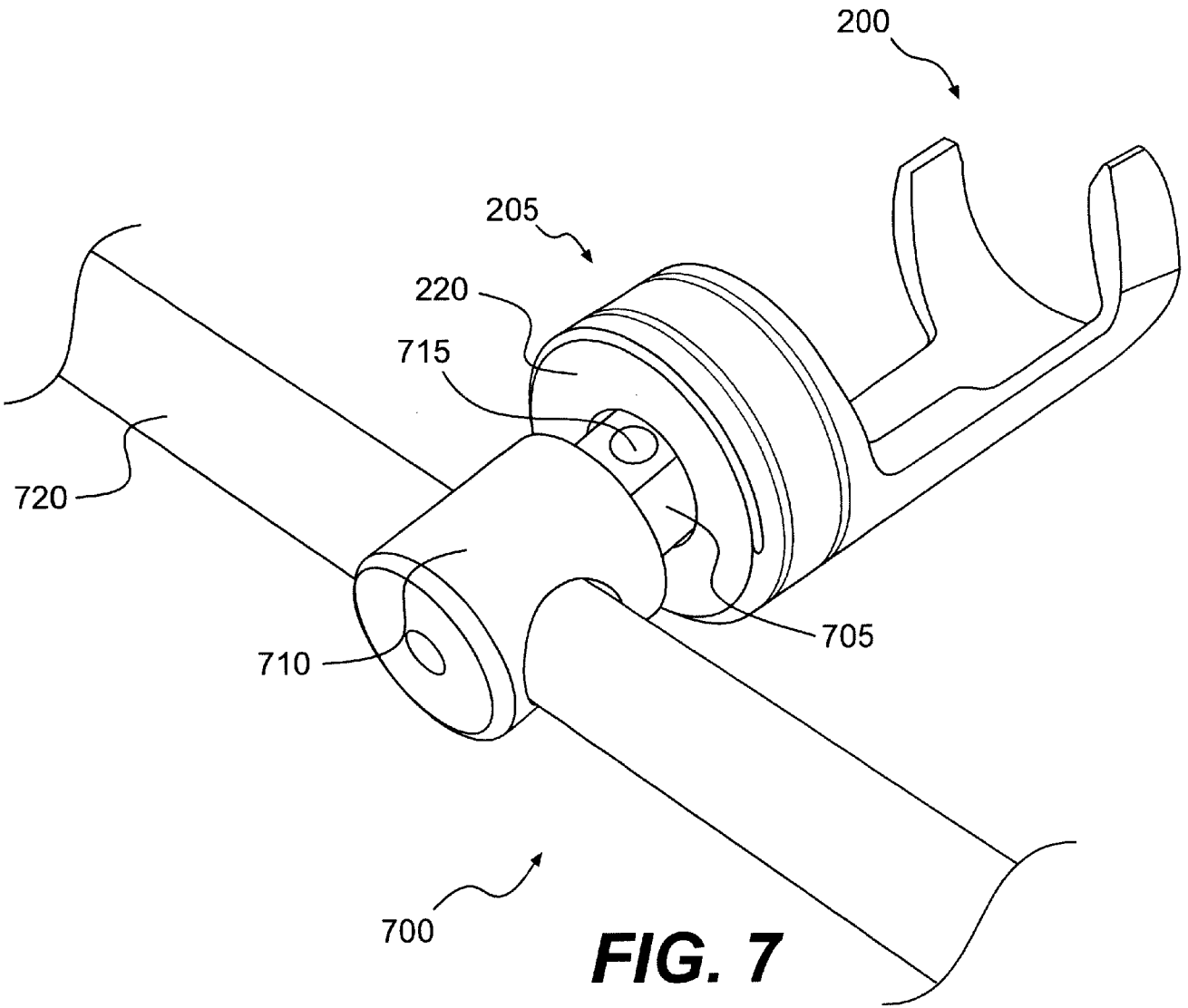
FIG. 7 is a perspective view of the wrench socket and torquing member consistent with the principles of the present invention.

FIG. 7 is a perspective view of the wrench socket in an engagement configuration with the torquing member of the present invention. In this exemplary embodiment, torquing member 700 comprises a lug member 705 integrally connected to a T-connection 710. Ball bearing 715 is disposed partially within lug member 705. An outer spherical surface of ball bearing 715 extends above a planar surface of lug member 705. A slidable rod 720 is inserted into a cylindrical cavity in T-connection 710. Slidable rod 720 is slidably connected with T-connection 710 and forms a handle for torqing member 700.

In FIG. 7, lug member 705 of the torquing member 700 is partially inserted into socket connection portion 205 of wrench socket 200. When lug member 705 is fully inserted, ball bearing 715 engages a detent on an interior surface of the socket cavity so as to hold the torquing member 700 in connection with the wrench socket 200. In the fully inserted position, first face 220 of socket connection portion 205 is adjacent to a surface of T-connection 710. The embodiment of FIG. 7 depicts a conventional socket tool connection commercially available and known to those skilled in the art.

In other embodiments of the present invention, torquing member 700 may be any convenient type of socket connection tool. For example, torquing member may be a ratchet, nut driver, torque wrench, or any other type of tool with a lug member enagable with/disengagable from the socket cavity. Torquing member may be a manually operated tool or a power tool.

FIG. 8 shows the wrench socket of the present invention in position of use and further illustrates its advantages. In FIG. 8, a standard communications cable 800 with a DIN-type connector is engaged with the wrench portion 215 of the present invention. Communications cable 800 comprises a cable 805 integrally connected with a housing 810. A coaxial connection 820 is also integrated into housing 810 so that an electrical connection is provided from the cable 805, through the housing 810, and to the coaxial connection 820. Hexagonal DIN nut 815 is rotatable about coaxial connection 820. Hexagonal DIN nut 815 is threaded for connection with a piece of communications equipment. Hexagonal DIN nut 815 is also attached to housing 810. To connect the communications cable 800 to a piece of equipment, coaxial connection 820 must be inserted into a receptacle on the equipment and hexagonal DIN nut 815 must be threadably engaged with the equipment. In this manner, the hexagonal DIN nut 815 holds the communications cable 800 in place on the equipment.

The interior faces and curved channels of wrench portion 215 engage the periphery of hexagonal DIN nut 815. As wrench portion 815 is rotated, hexagonal DIN nut 815 is either tightened or loosened. In engaging wrench portion 215 with hexagonal DIN nut 815, wrench portion 215 slides over housing 810. Since the hexagonal DIN nut 815 is located beyond housing 810, wrench portion 215 must first traverse housing 810 to engage hexagonal DIN nut 815. The position of housing 810 and cable 805 relative to hexagonal DIN nut 815 makes it difficult to connect and disconnect communications cable 800 from a piece of equipment.

Figure 9:
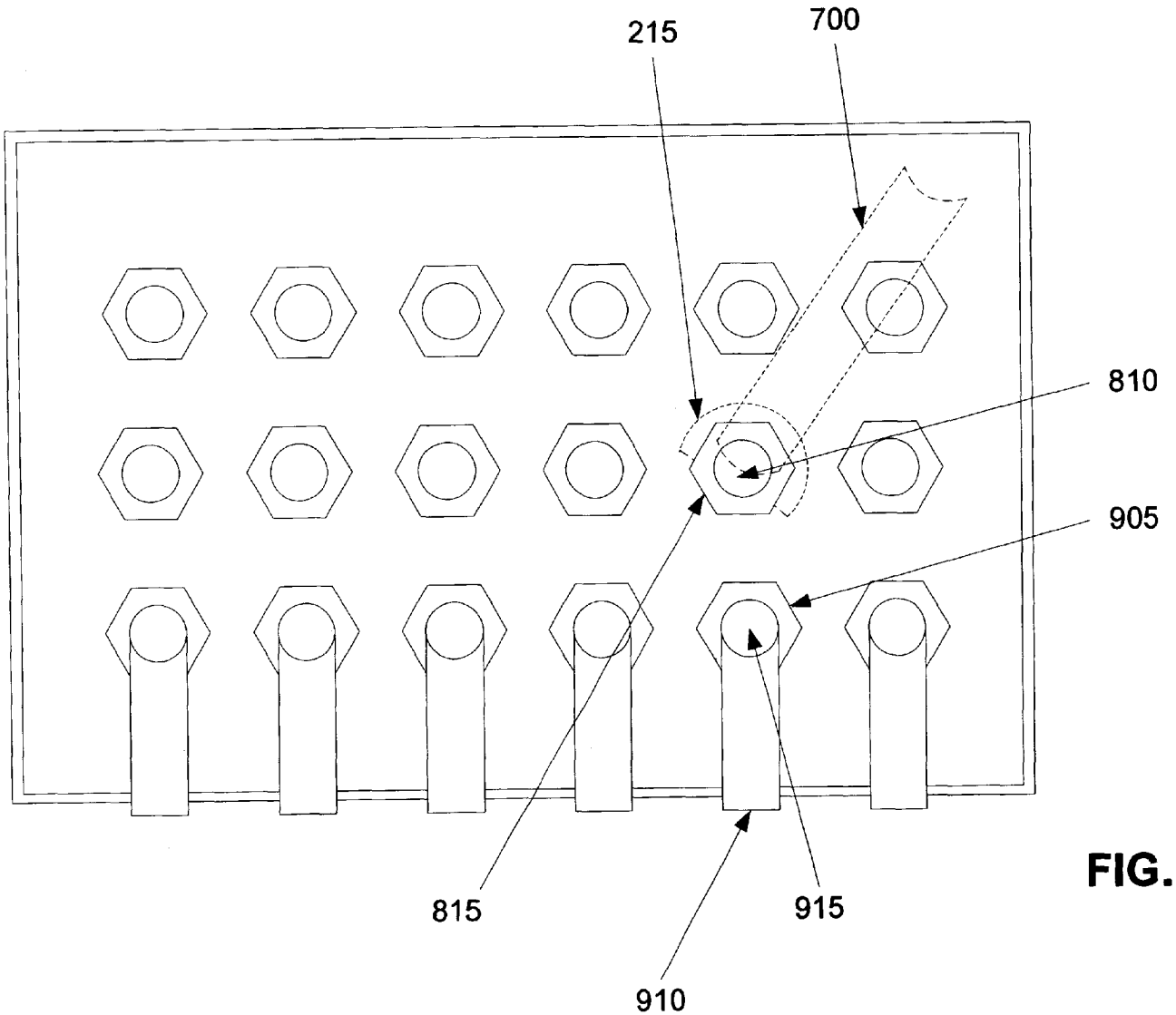
FIG. 9 illustrates the wrench socket consistent with the principles of the present invention positioned on one cable of a typical arrangement of communications cables.

This difficulty is better shown in FIG. 9 which depicts a typical installation of communications cables. As shown, communications cables are often arranged in arrays on a piece of communications equipment. For example, the cabling from radios to autotune combiners and from autotune combiners to filters in a conventional cellular communications site is often arranged in the manner depicted in FIG. 9. The location of adjacent cables and DIN-type connectors presents difficulties in connecting and disconnecting communications cables.

In FIG. 9, three rows of connections with six communications cables per row are disposed on a piece of communications equipment. The bottom row of communications cables and comprise a hexagonal DIN nut 905, a housing 915 and a cable 910. In the top two rows of communications cables only the hexagonal DIN nut 815 and housing 810 are depicted as a depiction of the cables would obscure the view of hexagonal DIN nut 815. In a typical installation, cables, such as cables 805 or 910, drape over the hexagonal DIN nuts, such as hexagonal DIN nut 815, thus complicating installation. A wrench must traverse the cables and housings to reach the hexagonal DIN nuts.

The wrench portion 215 and torquing member 700 of the present invention are depicted in dashed lines. Wrench portion 215 is in engagement with hexagonal DIN nut 815.

Torquing member 700 is disposed in a plane parallel to that of the hexagonal DIN nuts. As shown in FIG. 8, a distance is provided between housing 810 and socket connection portion 205 so as to provide clearance for torquing member 700. The profile of wrench portion 215 is such that it does not contact adjacent hexagonal DIN nuts when being rotated. In this fashion, wrench portion 215 is inserted over cable 805 and housing 810 before being engaged with hexagonal DIN nut 815.

Thus it will be seen that the present invention provides a wrench socket which is especially adaptable for use in tight installations. The wrench socket, while highly useful in servicing communications equipment, has almost unlimited application. It is highly useful in working on all types of cable connections where difficult access is provided either because of adjacent abutments or fittings or continuously running cable. Also, the wrench socket provides a positive grip, minimizing slippage relative to the fitting, thus preventing scarring or damage to the fitting.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A wrench socket, comprising:

a socket connection portion adapted to receive a lug member, the socket connection portion having a cavity extending along a longitudinal axis of the socket connection portion, the cavity adapted to matingly engage the lug member;

a wrench portion having an open gripping region for matingly engaging the periphery of a connector, the open gripping region comprising:

a plurality of inner faces that are substantially parallel to the longitudinal axis, the inner faces comprising: two nonadjacent inner faces, each disposed opposite the other; and at least one central inner face angularly oriented to, and disposed adjacently between, the two nonadjacent inner faces;

wherein a first length, along the longitudinal axis, of each of the nonadjacent inner faces is a fraction of a second length, along the longitudinal axis, of the at least one central inner face; and a mid portion disposed contiguously and longitudinally between the socket connection portion and the wrench portion so as to connect the socket connection portion to the wrench portion, and to transfer rotational force from the lug member to the wrench portion.

2. The wrench socket of claim 1, wherein the open gripping region is further for matingly engaging the periphery of a DIN-type connector.

3. The wrench socket of claim 1, wherein the wrench portion further comprises an outer surface wherein a lateral distance between the each of the inner faces of the wrench portion and the outer surface facilitates insertion of the wrench portion into a confined space.

4. The wrench socket of claim 1, wherein the plurality of inner faces are angularly oriented with respect to one another so as to approximate at least portions of four sides of a hexagon.

5. The wrench socket of claim 1, further comprising a plurality of curved channels each disposed between two adjacent inner faces, the curved channel disposed along a longitudinal line defined by the intersection of the adjacent inner faces.

6. The wrench socket of claim 5, wherein the radius of each of the plurality of curved channels is a fraction of the longitudinal length of each of the inner faces.

7. The wrench socket of claim 1, wherein the plurality of inner faces are coated with a non-metallic protective material.

8. The wrench socket of claim 1, wherein the at least one central inner face comprises a plurality of adjacent central inner faces.

9. The wrench socket of claim 1, further comprising:

a torquing member, comprising the lug member matingly engagable with and disengagable from the cavity of the socket connection portion, whereby torque applied to the torquing member is transferred to the wrench portion via the connection between the lug member and the socket connection portion.

10. The wrench socket of claim 9, wherein the torquing member is a torque type wrench.

11. The wrench socket of claim 9, wherein the torquing member further comprises a handle for rotating the lug member.

12. The wrench socket of claim 9, wherein the torquing member is a ratchet type wrench.

13. The wrench socket of claim 1, wherein the mid portion comprises an area between the wrench portion and the socket connection portion that is adapted to receive nonrotatable parts.

14. The wrench socket of claim 2, wherein the mid portion comprises an area between the wrench portion and the socket connection portion that is adapted to receive at least a portion of a coaxial cable.

15. A wrench socket, comprising:

a socket connection portion adapted to receive a lug member, the socket connection portion having a cavity extending along a longitudinal axis of the socket connection portion, the cavity adapted to matingly engage the lug member;

a wrench portion having an open gripping region for matingly engaging the periphery of a connector, the open gripping region comprising:

a plurality of inner faces that are substantially parallel to the longitudinal axis, the inner faces comprising: two nonadjacent inner faces, each disposed opposite the other; and at least one central inner face angularly oriented to, and disposed adjacently between, the two nonadjacent inner faces;

wherein the longitudinal length of each of the nonadjacent inner faces tapers away from the least one central inner face; and a mid portion disposed contiguously and longitudinally between the socket connection portion and the wrench portion so as to connect the socket connection portion to the wrench portion, and to transfer rotational force from the lug member to the wrench portion.

16. The wrench socket of claim 15, wherein the open gripping region is further for matingly engaging the periphery of a DIN-type connector.

17. The wrench socket of claim 15, wherein the wrench portion further comprises an outer surface wherein a lateral distance between the each of the inner faces of the wrench portion and the outer surface facilitates insertion of the wrench portion into a confined space.

18. The wrench socket of claim 15, wherein the plurality of inner faces are angularly oriented with respect to one another so as to approximate at least portions of four of the sides of a hexagon.

19. The wrench socket of claim 15, further comprising a plurality of curved channels each disposed between two of the inner faces that are adjacent to one another, the curved channel disposed along a longitudinal line defined by the intersection of the adjacent inner faces.

20. The wrench socket of claim 19, wherein the radius of each of the plurality of curved channels is a fraction of the longitudinal length of each of the inner faces.

21. The wrench socket of claim 15, wherein the plurality of inner faces are coated with a non-metallic protective material.

22. The wrench socket of claim 15, wherein the at least one central inner face comprises a plurality of adjacent central inner faces.

23. The wrench socket of claim 15, further comprising:

a torquing member, comprising the lug member matingly engagable with and disengagable from the cavity of the socket connection portion, whereby torque applied to the torquing member is transferred to the wrench portion via the connection between the lug member and the socket connection portion.

24. The wrench socket of claim 23, wherein the torquing member is a torque type wrench.

25. The wrench socket of claim 23, wherein the torquing member further comprises a handle for rotating the lug member.

26. The wrench socket of claim 23, wherein the torquing member is a ratchet type wrench.

27. The wrench socket of claim 15, wherein the mid portion comprises an area between the wrench portion and the socket connection portion that is adapted to receive nonrotatable parts.

28. The wrench socket of claim 16, wherein the mid portion comprises an area between the wrench portion and the socket connection portion that is adapted to receive at least a portion of a coaxial cable.

* * * * *